United States Patent [19]

Albert

[11] Patent Number: 4,571,121

[45] Date of Patent: Feb. 18, 1986

[54] UNDERWATER EROSION PREVENTION AND BACKFILL SYSTEM WITH BARRIER BAG INSTALLATION

[76] Inventor: Bruce J. Albert, 637 Petit Berdot, Kenner, La. 70065

[21] Appl. No.: 585,358

[22] Filed: Mar. 1, 1984

[51] Int. Cl.[4] ..... E02B 3/00; E02D 31/00

[52] U.S. Cl. ..... 405/15; 405/73; 405/211; 405/226

[58] Field of Search ..... 405/15, 73, 74, 117, 405/185, 195, 211, 224, 226; 37/56, 58

[56] References Cited

U.S. PATENT DOCUMENTS

| | | | |
|---|---|---|---|
| 358,853 | 3/1887 | Goodridge | 405/222 |
| 983,808 | 2/1911 | Christiansen | 405/226 |
| 3,665,720 | 5/1972 | Havno | 405/226 |
| 3,683,521 | 8/1972 | Sloan et al. | 37/56 |
| 4,420,275 | 12/1983 | Ruser | 405/15 X |

*Primary Examiner*—David H. Corbin

*Attorney, Agent, or Firm*—Pravel, Gambrell, Hewitt & Kimball

[57] ABSTRACT

An underwater backfilling apparatus which can be used by undersea divers provides a sediment intake which is randomly movable by a diver over the ocean floor for removing sediment material from the seabed which is to be used in underwater backfilling. A handheld discharge dispenses the sediment material into a selected void space to be backfilled with the sediment which is removed by the intake from the seabed. A conduit connects the intake and the discharge with a bore so that sediment can be transmitted from the intake to the outlet. A fluid drive is positioned in the conduit between the inlet and the outlet for moving a mixture of sediment and seawater through the conduit. The fluid drive in the preferred embodiment includes a fluid conveying tubular member having an inlet and an outlet which are connectable to the conduit, a branch conduit line extending angularly from the tubular member and forming an acute angle at the point of intersection with the tubular member and a fluid pump which is connectable to the branch conduit line for injecting a moving fluid mass into the bore of the tubular member so that the moving fluid mass can produce flow through the conduit between the inlet and the outlet.

15 Claims, 7 Drawing Figures

UNDERWATER EROSION PREVENTION AND BACKFILL SYSTEM WITH BARRIER BAG INSTALLATION

BACKGROUND OF THE INVENTION

1. Technical Field

The present invention relates to undersea dredging and backfilling and more particularly relates to a method and apparatus for the prevention of underscour and erosion, and backfilling of void spaces around undersea rigs, barges, and rig foundations and the like.

2. General Background

There are numerous types of offshore platforms and rigs which are used for the drilling and/or production of oil and gas wells. Most offshore platforms use a substructure which is somehow based upon the seabottom. Permanent structures use piling which are driven into the underlying soil mass of the seabed a large distance so as to develop sufficient structural integrity so that a jacket or rig structure can be fastened or otherwise affixed to the piling, usually by welding.

Some offshore platforms are of a movable type which can be transported to and from job sites and reused in various places as work occurs. For example, jackup rigs use a plurality of legs which raise and lower a barge above the surface of the water, the legs providing a firm base on the seabed. Another type of offshore platform or rig is a submersible barge supported rig often called a workover rig. These devices use a substructural barge upon which is mounted a jacket or other network of legs or pipes that extend upwardly and support a second superstructure above the water surface. For example, if the workover rig is operating in water depths of fifty feet, the substructural barge might sit on the bottom and the legs of the rig might extend eighty feet upwardly to the deck of the barge which would then be thirty feet above the water surface. It should be understood that the method and apparatus of the present invention is not limited to shallow depths of, e.g., fifty feet. This method of erosion prevention is not limited to any depth, and may be used for deep-draft drilling platforms with piling legs as well as submerged barge types.

Such rigs using a substructural barge do not rely upon piling for anchoring the rig to the seabed. Rather, the substructural barge rests directly upon the seabed itself.

Over a long period of time, undersea currents and the surface currents generated by workboats and other such surface vessels can wash away the seabed or underlying soil mass which supports the substructural barge. In these cases, the barge is unsupported at the washed out area and severe washout can eventually threaten the structural integrity of the entire rig. One solution to this problem is to manually install sandbags which are transported to the work site with a workboat, barge or the like. The sandbags are then manually placed in the void spaces around the rig substructure by divers. This is a very time-consuming and expensive process. Not only must the divers expend a tremendous amount of time and effort to transport small sandbags one at a time to the area which is washed out, but the bags themselves must be first loaded onto a barge and then transported to the site for use. If not enough bags are available, multiple trips must be made. Oftentimes, the owner of the workover rig or other such vessel must actually purchase the sandbags if sand is not readily available or beaches near the rig. The usual case requires purchase of sand in bags such as one hundred pound sacks of sand. These bags are conveyed to the job by barge or workboat. Individual bags are then dumped into the water and properly positioned by divers.

GENERAL DISCUSSION OF THE PRESENT INVENTION

The present invention provides an erosion prevention and backfilling apparatus for use by divers. The system includes a sediment intake which is randomly movable by a diver for removing sediment material from the seabed which is to be used for underwater erosion prevention and backfilling. A handheld discharge dispenses sediment material into a selected void space to be backfilled with the sediment material by a diver; the same discharge dispenses sediment material into barrier bags. A conduit connects the intake and a discharge with a bore so that sediment material can be transmitted from the intake to the outlet. A fluid drive positioned in the conduit between the inlet and the outlet moves the mixture of sediment and seawater through the conduit. In the preferred embodiment, the fluid drive includes a fluid conveying tubular member having an inlet and an outlet which are connectable to the conduit. A branch conduit line extends angularly from the tubular member and forms an acute angle at the point of intersection with the tubular member. A fluid pump is connectable to the branch conduit line for injecting a moving fluid mass into the bore of the tubular member so that the moving fluid mass can produce flow through the conduit between the inlet and the outlet. The present invention provides a method for erosion control of submersible barges which are positioned upon the seabed. In the method of the present invention, void spaces created by a scour are first filled with sediment material which is removed from the seabed immediately adjacent the barge with a sediment intake. A handheld discharge then dispenses the sediment material into the selected void space to be backfilled with the sediment. A conduit is used between the intake and discharge for transporting the sediment material from the inlet to the outlet so that it can be dispensed into the void space. A fluid drive moves a mixture of sediment and seawater through the conduit from the inlet to the outlet. After the void spaces are filled, a barrier of flexible wall containers or bags is placed about the perimeter of the barge, each of the bags being filled by transmission of a sand and fluid mixture which is placed into the plurality of barrier bags. The bags are rectangular in cross-section so that they interface correspondingly with the intersection of the barge and the seabed. In the preferred embodiment, the intake includes a wheeled carriage having an intake position downwardly toward the seabed. The intake can include a scraper for scarrifying the seabed so that sediment can be mechanically broken up adjacent the intake. Connection means on the carriage allows a conduit to be connected to the carriage body so that suction in the conduit will create a suction on the lower surface of the opening. The flexible wall receptacle or barrier bag can be of a biodegradable material so that it will self-destruct over a relatively short period of time leaving the fill material at the interface of the barge and seabed.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
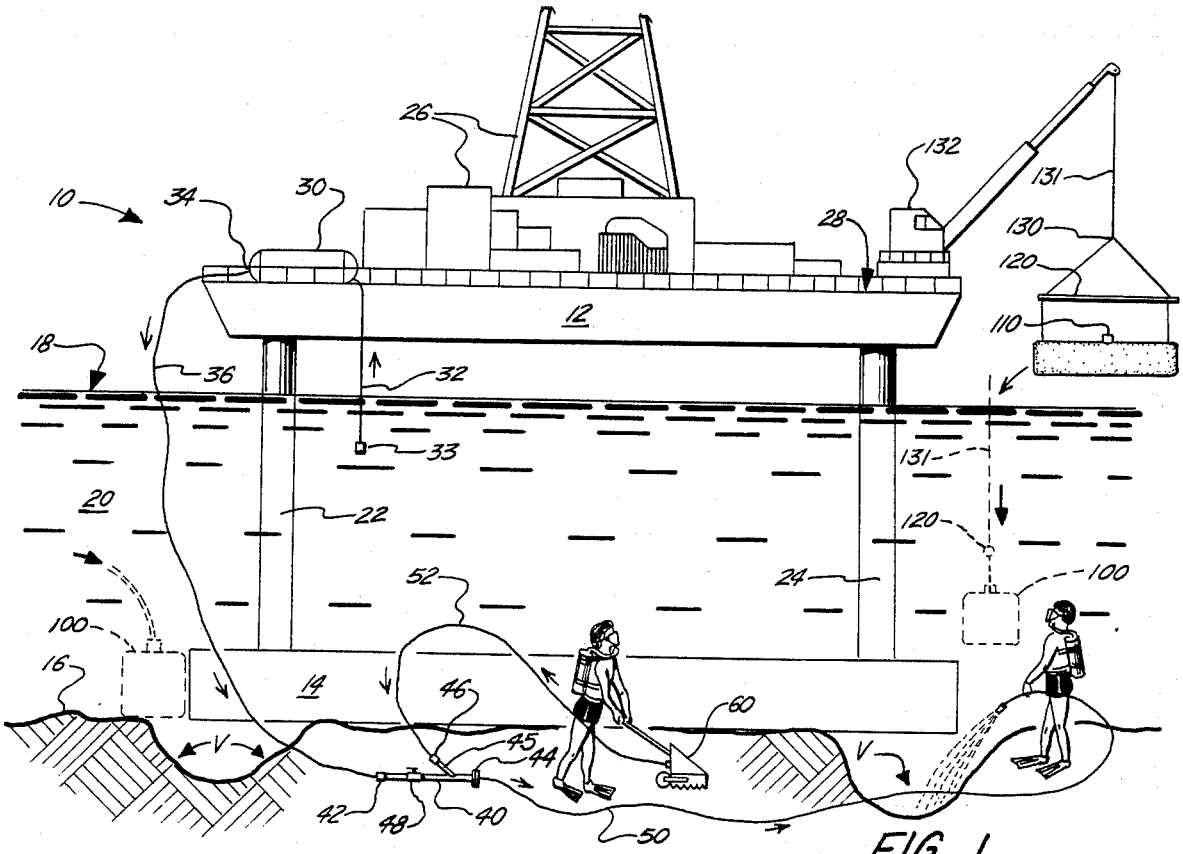
FIG. 1 is a elevational view of the preferred embodiment of the apparatus of the present invention illustrating both the method and apparatus thereof.
Figure 2:
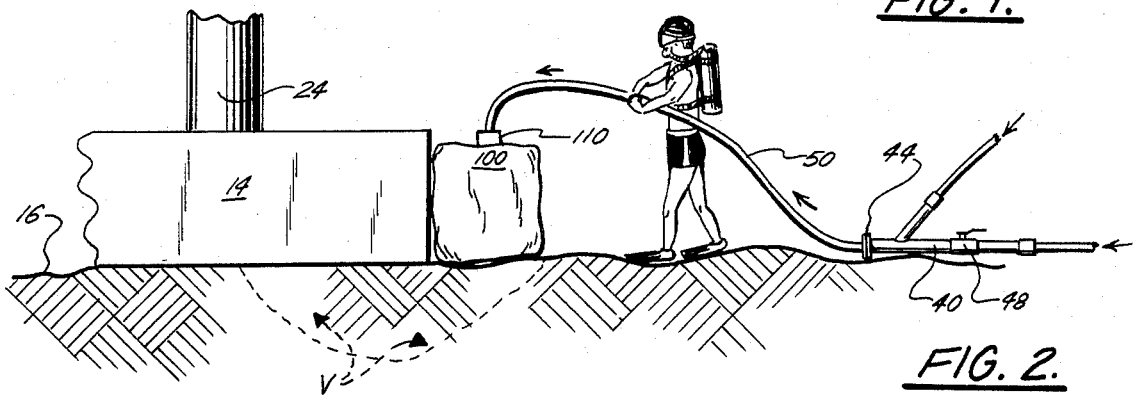
FIG. 2 is a fragmentary elevational view of the preferred embodiment of the apparatus of the present invention illustrating placement and filling of the barrier bag portions thereof.

FIGS. 1–2 illustrate generally the preferred embodiment of the apparatus of the present invention designated generally in FIG. 1 by the numeral 10. FIG. 1 shows a workover rig 12 having a lowermost substructure 14 in the form of a submersible barge having a plurality of upwardly extending support legs 22, 24 which elevate an upper deck 28 above the water surface 18. A workover rig superstructure 26 is generally and schematically shown in the drawings which might include, for example, crewquarters, equipment, a derrick, and the like.

Substructure barge 14 rests directly upon the seabed 16. A problem arises over a period of time when void spaces V are created because of ocean current, underscour, and currents created by vessels which supply materials and bring crewmembers to and from the rig 12. The void spaces are shown in FIG. 1 prior to backfilling using the method and apparatus of the present invention.

Figure 4:
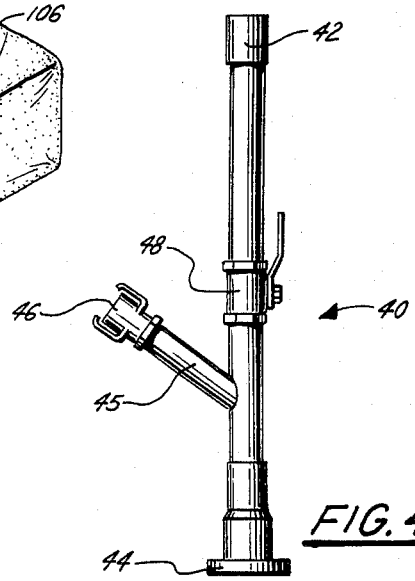
FIG. 4 is a top view of a fluid drive pump as used with the preferred embodiment of the method and apparatus of the present invention.

In FIG. 1, a pair of divers can be seen working in the water 20 surrounding the rig substructure 14. Upon the deck 28 of rig 12 is provided a pumping apparatus 30 having a conduit 36 attached thereto at 34. Flow through conduit 36 is generally in the direction shown by the arrows in FIG. 1. The pumping assembly 32 can also have a suction or intake line 32 with a fluid intake 33 which receives seawater for movement through the pump 30 and then into conduit 36. Conduit 36 attaches at its opposite end portions to fluid drive pump 40 and more particularly at the intake 42 thereof. The connection 42 can be, for example, a threaded connection or other suitable connection for joining flexible rubber hose or other such suitable material thereto. Fluid drive pump 40 is more particularly shown in FIG. 4 and includes intake connection 42, discharge connection 44, and branch line 45. Valve 48 also allows the central bore of drive 40 to be closed. It should be understood that fluid drive pump 40 provides a hollow tubular member so that flow can proceed through the bore thereof between intake 42 and discharge 44. Likewise, branch member 45 is hollow having a tubular bore so that fluid can flow from branch intake 46 to discharge 44. Fluid drive pump 40 would be constructed of schedule 40 or schedule 80 pipe with the various parts being either threaded or welded together.

A sediment suction line 52 connects branch intake 46 with sediment intake carriage 60. Note that carriage 60 is more particularly shown in FIGS. 5 and 6. Carriage 60 is wheeled having a roller 80 which allows it to be moved about the seabed 16 by the diver. Thus, intake carriage 60 can be selectively moved into any of a number of desired positions so as to intake sediment which is useful in the backfilling operation. The diver can not only move the intake carriage 60 to a selected area, but can continue to move the carriage 60 all over the seabed so as to collect only selected fill material, or to use fill material from areas which are especially built up with sand or other useful backfill material. The wheeled intake allows the diver a tremendous amount of selectibility in the fill material to be selected and used.

Discharge conduit 50 attaches to connection 44 at one end portion and at its other end portion provides a nozzle or other suitable handheld discharge so that a second diver can use the nozzle to backfill the void spaces as shown in FIG. 1.

After all of the void spaces V have been backfilled, the diver as shown in FIG. 2 uses conduit 50 to fill a plurality of barrier bags designated as 100 in the drawings. Each barrier bag provides an intake 110 and a plurality of weep holes 108 through which fluid can escape during the filling process. In this manner, a means for separating seawater from backfill material is provided in barrier bag 100.

Figure 7:
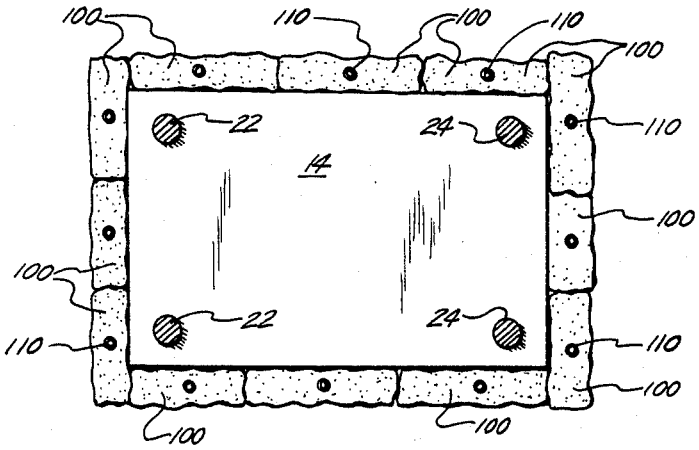
FIG. 7 is a partial plan view of the preferred embodiment of the apparatus of the present invention illustrating placement of the barrier bag portions thereof about the barge substructure at its interface with the seabed.

FIG. 7 illustrates the placement of a plurality of barrier bags 100 about barge substructure 14. Notice that each bag is rectangular in cross-section and thus neatly fits the interface of barge substructure 14 and the seabed 16 (see FIGS. 2 and 7). The barrier bag inlet openings 114 can be provided, for example, with a tie string or the like so as to tightly close the intake 114 after filling is completed. The diver can visually inspect weep holes 108 during filling to assure that seawater has fully separated from the fill material and likewise insure that the bag is completely filled with backfill material such as sand rather than seawater.

Figure 3:
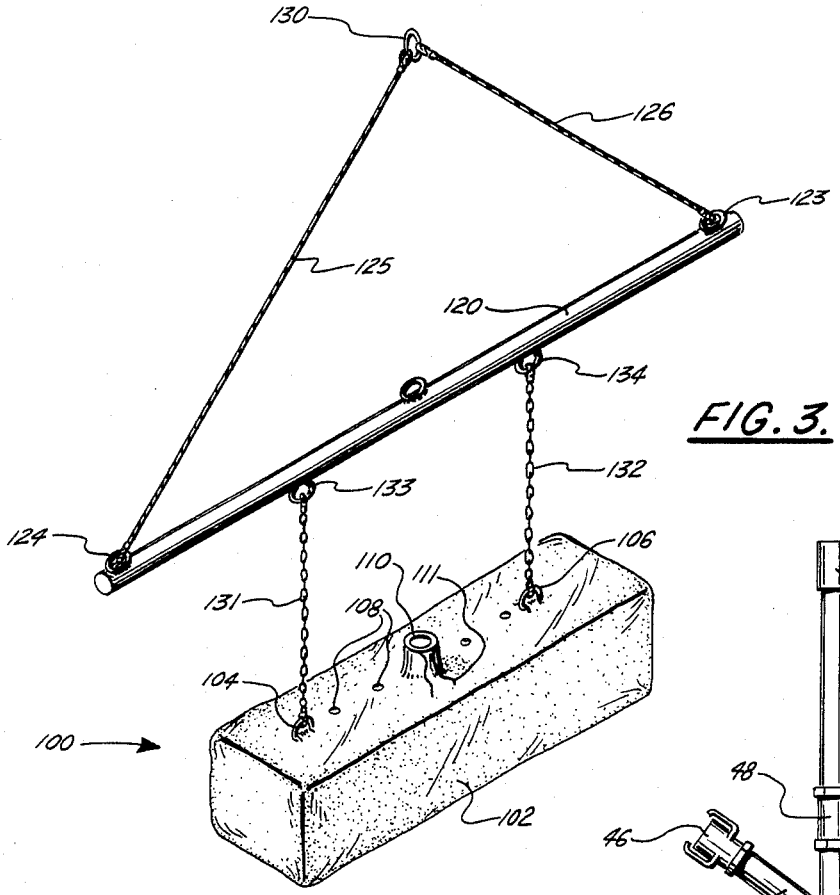
FIG. 3 is a fragmentary perspective view of the preferred embodiment of the apparatus of the present invention illustrating the barrier bag portion thereof and its lifting assembly.

FIG. 3 shows more particularly the barrier bag 100 as comprising a flexible wall 102 which is generally rectangular in cross-section. Top and side views of barrier bag 100 can also be seen in FIGS. 2 and 7. In FIG. 3, a barrier bag 100 is shown as supported by a pair of lift chains 131, 132 which attach to lifting eye rings 104, 106 which are sewed or otherwise affixed structurally to the bag wall 102.

A spreader bar assembly is shown lifting chains 131, 132 with the bar including a pair of spaced apart lifting rings 133, 134 to which the chain is attached. The end portions 123, 124 of the spreader bar also provide rings to which branch or bridle lines 125, 126 can attach with a common lift ring 130 being provided to which a crane can attach a lifting line (see FIG. 1).

Figure 5:
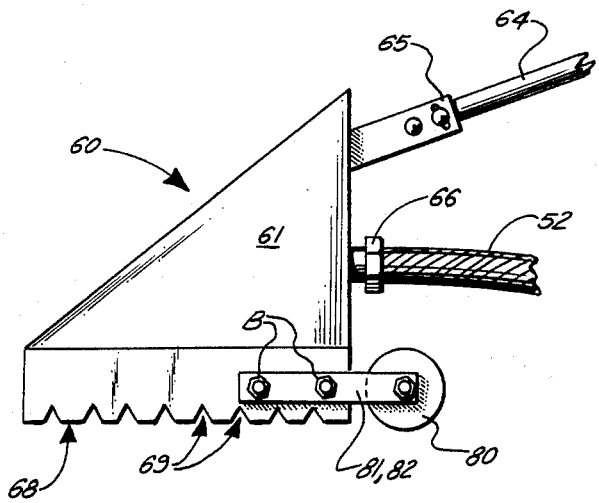
FIG. 5 is a fragmentary view of the preferred embodiment of the apparatus of the present invention illustrating the sediment intake carriage thereof.
Figure 6:
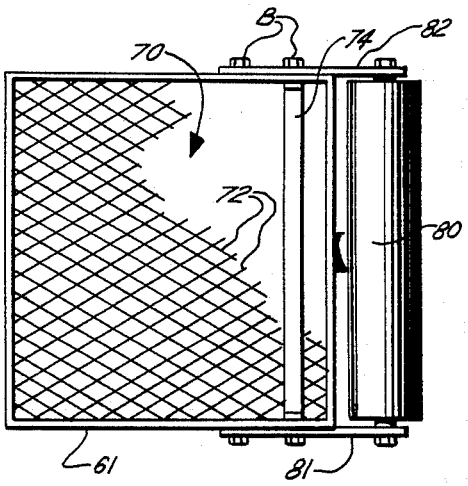
FIG. 6 is a bottom view of the sediment intake carriage of the preferred embodiment of the apparatus of the present invention.

FIG. 5 shows more particularly the construction of wheeled intake carriage 60. Carriage 60 provides a roller 180 which is attached thereto by means of brackets 81, 82 and bolted connections B. The underside 68 of carriage 60 provides a plurality of indentations 69 thus defining teeth therebetween which can be used to scarrify the underlying seabed during operation.

Above roller 80 is provided a detachable connection 66 to which conduit 52 can attach. Handle 64 attaches by means of bracket 65 so that a diver can move carriage 60 about the seabed in order to selectively gather backfill material during operation.

The lowermost surface 70 of carriage 60 defines an intake which is covered with screens 72 so as to prevent inordinately large portions of the seabed, rocks and the like from entering conduit 52.

Because many varying and different embodiments may be made within the scope of the inventive concept herein taught, and because any modifications may be made in the embodiments herein detailed in accordance with the descriptive requirement of the law, it is to be understood that the details herein taught are to be interpreted as illustrative and not in a limiting sense.

What is claimed as the invention is:

1. An underwater backfilling apparatus for use by divers comprising:

a. sediment intake means randomly movable by a diver for removing sediment material from the seabed which is to be used for backfilling;

b. handheld discharge means for dispensing sediment material into a selected void space to be backfilled with the sediment material by a diver;

c. conduit means connecting the intake means and the discharge means with a bore so that sediment material can be transmitted from the intake means to the outlet means; and d. fluid drive means positioned in the conduit means between the inlet means and outlet means for moving a mixture of sediment and seawater through the conduit.

2. The underwater backfilling apparatus of claim 1, wherein the fluid drive means comprises:

a fluid conveying tubular member having an inlet and an outlet which are connectable to the conduit means;

a branch conduit line extending angularly from the tubular member and forming an acute angle at the point of intersection with the tubular member;

fluid drive means connectable to the branch conduit line for injecting a moving fluid mass into the bore of the tubular member so that the moving fluid mass can produce flow through the conduit between the inlet means and outlet means.

3. The underwater backfilling apparatus of claim 1, wherein the intake means comprises a wheeled carriage having an intake positioned downwardly toward the seabed.

4. The underwater backfilling apparatus of claim 1, wherein the intake means is a carriage having an intake and scraper means for scarrifying the seabed so that sediment can be mechanically broken up adjacent the intake.

5. The underwater backfilling apparatus of claim 1, wherein the intake means comprises:

a carriage body having a lower surface opening;

connection means on the carriage body for connecting the conduit means to the carriage body so that a suction in the conduit will create a suction at the lower surface opening; and means for supporting the carriage a small distance from or directly upon the seabed.

6. The underwater backfilling apparatus of claim 5 further comprising scraper means for scarrifying the seabed so that sediment can be mechanically broken up adjacent the lower surface opening.

7. The underwater backfilling apparatus of claim 6 further comprising receptacle means connectable to the discharge means for collecting sediment material discharged therefrom.

8. The underwater backfilling apparatus of claim 7, wherein the receptacle means has a flexible wall.

9. The underwater backfilling apparatus of claim 8, wherein the receptacle provides means for separating seawater from sediment material so that sediment material is retained within the receptacle means and seawater is allowed to escape from the receptacle means.

10. The underwater backfilling apparatus of claim 8, wherein the receptacle means has a rectangular cross-section.

11. A method for controlling erosion around offshore rig substructures comprising the steps of:

a. providing underwater conduit through which backfill material can be transported to the area adjacent a rig substructure having eroded void spaces in need of control;

b. scarrifying the seabed with one end portion of the conduit to mechanically break up suitable backfill material;

c. creating a suction in the underwater conduit by injecting fluid into the conduit at an angle which creates a suction at the intake portion of the conduit and a discharge at the effluent end portion of the conduit; and e. using the effluent end portion of the conduit to backfill the void spaces around the rig.

12. The method of claim 11, wherein the suction is created by a fluid drive pump positioned between the inlet and the outlet portions of the conduit.

13. The method of claim 12, wherein the fluid drive comprises a fluid pump having a linear section which is placed in the conduit so that flow through the conduit proceeds through the linear portion of the fluid pump, and the fluid pump further includes a lateral branch section which forms an acute angle with the in-line section of the fluid drive pump.

14. The method of claim 11 further including the step of filling one or more flexible bags with fill material which is transported from the seabed adjacent the rig through the conduit and into the bag so that the bag forms an erosion control interface where the rig substructure meets the seabed.

15. The method of claim 12 further including the step of preliminarily filling the void spaces in the seabed at the interface with the rig substructure, and secondarily filling a plurality of erosion control bags which are placed at the seabed/rig interface.

* * * * *